US008849180B2

(12) United States Patent
Kimura et al.

(10) Patent No.: US 8,849,180 B2
(45) Date of Patent: Sep. 30, 2014

(54) IMAGE FORMING APPARATUS

(75) Inventors: Masaki Kimura, Kanagawa (JP); Gakushi Tanaka, Kanagawa (JP); Tsuyoshi Endo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 252 days.

(21) Appl. No.: 13/206,658

(22) Filed: Aug. 10, 2011

(65) Prior Publication Data

US 2012/0045263 A1 Feb. 23, 2012

(30) Foreign Application Priority Data

Aug. 19, 2010 (JP) ..... 2010-183853
Sep. 3, 2010 (JP) ..... 2010-197258

(51) Int. Cl.
*G03G 15/00* (2006.01)

(52) U.S. Cl.
USPC ..... 399/405; 271/279; 271/286

(58) Field of Classification Search
CPC ..... G03G 15/6552
USPC ..... 399/405; 271/279, 286
See application file for complete search history.

(56) References Cited

U.S. PATENT DOCUMENTS

| | | | | |
|---|---|---|---|---|
| 5,987,296 | A * | 11/1999 | Shimada et al. | 399/330 |
| 2005/0158095 | A1* | 7/2005 | Nagayama | 399/405 |
| 2009/0121414 | A1* | 5/2009 | Ito | 271/209 |

FOREIGN PATENT DOCUMENTS

| | | |
|---|---|---|
| JP | 8-91672 | 4/1996 |
| JP | 09-185312 | 7/1997 |
| JP | 11-186767 | 12/1997 |
| JP | 2003-40508 | 2/2003 |
| JP | 2007-148102 | 6/2007 |
| JP | 2007-219399 | 8/2007 |
| JP | 2009-288742 | 12/2009 |
| JP | 2010-156863 | 7/2010 |

OTHER PUBLICATIONS

Japanese Office Action issued in JP 2010-197258 on Feb. 18, 2014.

* cited by examiner

*Primary Examiner* — Matthew G Marini
*Assistant Examiner* — Allister Primo
(74) *Attorney, Agent, or Firm* — Oblon, Spivak, McClelland, Maier & Neustadt, L.L.P.

(57) ABSTRACT

An image forming apparatus includes an image forming part configure to form an image on a sheet of paper; and a paper ejection tray, provided above an image forming part, including a supporting part configured to support the sheet of paper ejected after having the image formed thereonto by the image forming part, and a radiation opening configured to radiate therethrough heat from the image forming part to the outside air. The radiation opening is provided lower than the supporting part.

7 Claims, 14 Drawing Sheets

IMAGE FORMING APPARATUS

BACKGROUND OF THE INVENTION

1. Field of the Invention

The present invention relates to an image forming apparatus of an electrophotographic type such as a copier, a facsimile machine, a printer, or a multifunction peripheral (MFP) in which functions of at least two of a copier, a facsimile machine and a printer are included. In more detail, the present invention relates to an improvement in a radiation part provided in an image forming apparatus of an electrophotographic type.

2. Description of the Related Art

Recently, as a configuration of an image forming apparatus of an electrophotographic type, such a configuration comes to play a major role in response to a demand for downsizing a space of installing the image forming apparatus that paper is ejected to a paper ejection tray provided immediately above an image forming part of the image forming apparatus, from such a configuration that a paper ejection tray is provided on a side surface of a body of the image forming apparatus.

However, the image forming part includes an apparatus that generates heat by itself such as an image forming unit. Thus, it may be necessary to provide a radiation part that discharges heated air to the outside of the body of the image forming apparatus to radiate the heat.

As such a radiation part of an image forming apparatus, there is a configuration where an opening is provided on a side surface of a body of the image forming apparatus, an airflow is created mechanically by means of a fan motor or such, and heated air is forcibly discharged to the outside of the body of the image forming apparatus (see Japanese Laid-Open Patent Application No. 2007-148102, for example). Another configuration may be such that an opening is provided in a top of an image forming apparatus such as a top surface of a body of the image forming apparatus, and heated air is discharged to the outside of the body of the image forming apparatus by means of natural convection.

SUMMARY OF THE INVENTION

According to an embodiment of the present invention, an image forming apparatus includes a paper ejection tray above an image forming part, the paper ejection tray includes a supporting part configured to support an ejected sheet of paper and a radiation opening configured to radiate therethrough heat from the image forming part to the outside air, and the radiation opening is provided lower than the supporting part.

Other objects, features and advantages of the present invention will become more apparent from the following detailed description when read in conjunction with the accompanying drawings.

DETAILED DESCRIPTION OF THE EMBODIMENTS

Figure 1:
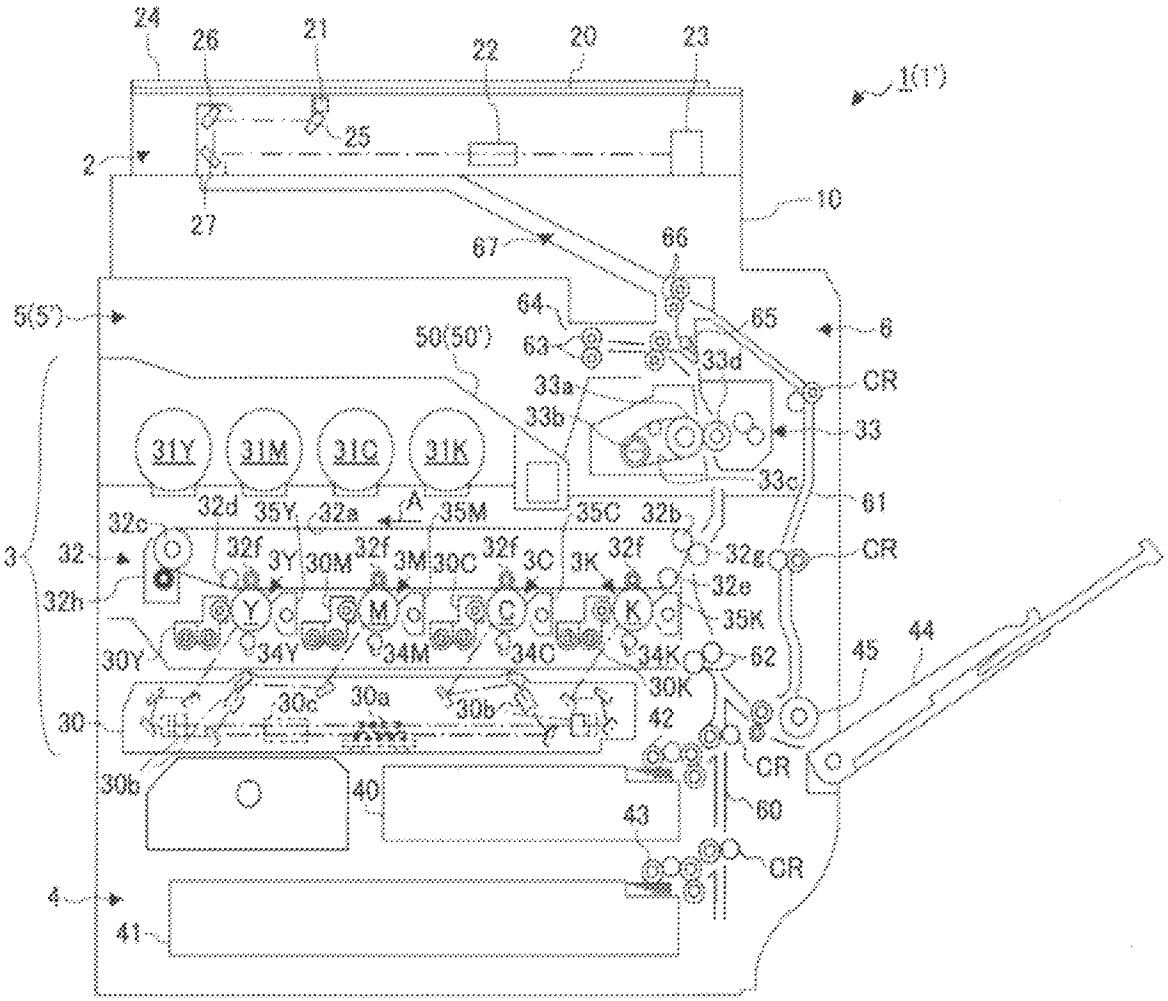
FIG. 1 generally shows in a see-through manner a front view of an image forming apparatus according to an embodiment 1 of the present invention.

An object of an embodiment of the present invention is to provide an image forming apparatus in which even in a case where a paper ejection tray is provided above an image forming part, it is possible to effectively radiate heat by means of natural convection.

According to an embodiment of the present invention, an image forming apparatus includes a paper ejection tray above an image forming part, the paper ejection tray includes a supporting part configured to support an ejected sheet of paper and a radiation opening configured to radiate therethrough heat from the image forming part to the outside air, and the radiation opening is provided lower than the supporting part. Thereby, the radiation opening is prevented from being blocked by the ejected sheet of paper that is supported by the supporting part of the paper ejection tray, so that heat generated from the image forming part is efficiently radiated through the radiation opening by means of natural convection.

The radiation opening may be disposed at a position that is shifted from the supporting part in a direction parallel to a plane on which the paper ejection tray extends.

The paper ejection tray may have a projection and a depression. The projection acts as the supporting part and the radiation opening is provided on the depression.

The projection may have an inclined surface that is inclined upward along a direction in which the ejected sheet of paper is ejected from a paper ejection opening, and may be higher than a surrounding surface. Thereby, the ejected sheet of paper is prevented from being blocked by the projection, and is smoothly ejected.

The projection may be capable of being moved between a position at which the projection projects upward from a surrounding surface and a position at which the projection is flush with the surrounding surface. Thereby, it is possible that the projection is temporarily retracted to be flush with the surrounding surface if the projection is obstructive. Thus, it is possible to eject the ejected sheet of paper more smoothly.

The depression may have a flat bottom surface depressed with respect to a surrounding surface, and the radiation opening is provided on the bottom surface. Thereby, in a case where a user sees the radiation opening from a top oblique direction that is customary when the user uses the image forming apparatus, a hole of the radiation opening is hidden and becomes inconspicuous.

The projection of the paper ejection tray may be capable of being moved between a position at which the projection projects upward from a surrounding surface and a position at which the projection is flush with the surrounding surface. In this case, the radiation opening configured to radiator heat from the image forming part to the outside air may be provided in the inside of the projection. Thereby, even in a case where the paper ejection tray is provided immediately above the image forming part, the radiation opening is prevented from being blocked by the ejected sheet of paper in the state where the projection projects upward from the surrounding surface, and heat generated by the image forming part is efficiently radiated through the radiation opening by means of natural convection. Furthermore, in a case where it is not necessary to radiate heat of the image forming part to the outside air such as when transporting the image forming apparatus, it is possible to retract the projection and thereby the radiation opening is closed by the projection. Thus, it is possible to prevent dust/dirt from entering the inside of the body of the image forming apparatus through the radiation opening.

The radiation opening may have a grid in which the largest length of each of the individual openings within the grid is equal to or less than 5 mm, or a slit member in which a width of each of individual openings (slits) is equal to or less than 1 mm. Thereby, the radiation opening is not regarded as an opening of a housing of such an image forming apparatus according to a safety standard. Therefore, the limitations according to the safety standard are not applied to parts/components provided in the inside of the radiation opening, and thus, freedom in designing is increased.

Below, with reference to figures, embodiments of the present invention will be described.

Embodiment 1

Entire Configuration of Image Forming Apparatus

With reference to FIG. 1, the entire configuration of an image forming apparatus according to an embodiment 1 of the present invention will be described. A color copier (image forming apparatus) 1 illustrated as the embodiment 1 of the present invention uses an electrophotographic system, and is of such a type that a paper ejection part 5 (described later) is included in a body of the image forming apparatus 1. The color copier 1 includes the body 10 of the image forming apparatus 1, an image reading part 2, an image forming part 3, a paper feeding part 4, a paper ejection part 5 and a paper conveyance path 6. The body 10 of the image forming apparatus 1 is a housing of the entirety of the image forming apparatus, and is generally like a box having an opening at the top surface. The image reading part 2 is disposed above the body 1 of the image forming apparatus 1, and reads an image of an original document or such.

The image forming part 3 is disposed below the image reading part 2, and forms an image based on image information that has been read by the image reading part 2 or transmitted from an external apparatus. The paper feeding part 4 is disposed at the bottom of the body 10 of the image forming apparatus 1, and supplies a sheet of paper (which means, herein and hereinafter, a sheet-shaped member such as copy paper, a resin sheet for an OHP (Over Head Projector), a cardboard, or a postcard) to the paper conveyance path 6. The paper ejection part 5 ejects the sheet of paper. The paper conveyance path 6 is provided between the paper feeding part 4 and the paper ejection part, and conveys the sheet of paper therebetween.

Figure 2:
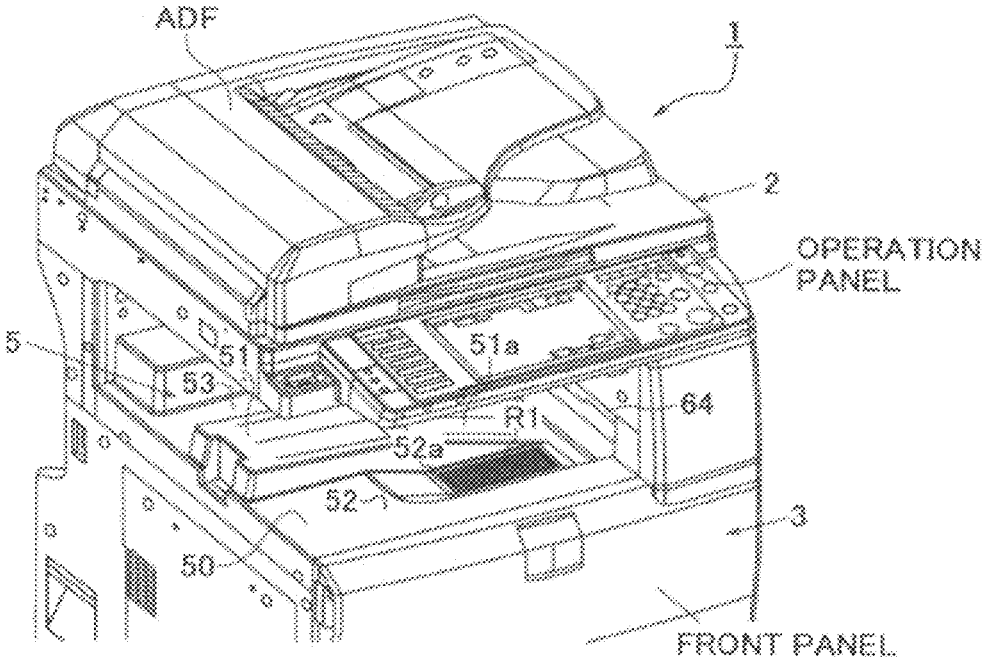
FIG. 2 partially shows a perspective view of the image forming apparatus shown in FIG. 1 taken from a top-left-front oblique direction.

The image reading part 2 includes a contact glass 20, a light source 21, a imaging lens 22, an image sensor 23 and plural mirrors 25, 26 and 27 that reflect light reflected by the original and leads it to the imaging lens 22. The contact glass 20 is mounted at the top surface part of the body 10 of the image forming apparatus 1, and the original is placed on the contact glass 20. The light source 21 is disposed immediately below the contact glass 20, and, while moving, emits light to the original. The imaging lens 22 focuses light reflected by the original. The image sensor 23 can be, for example, a CCD (Charge Coupled Device) and is disposed at a position at which the reflected light is focused by the imaging lens 22 and acts as a reading part that reads the original. Above the image reading part 2, a press plate 24 is provided. The press plate 24 is used to securely hold the original, which is placed on the contact glass 20, onto the contact glass 20. It is noted that instead of the press plate 24, an automatic draft feeder (ADF) may be provided (see "ADF" in FIG. 2). The ADF automatically supplies a sheet of paper onto the contact glass 20.

The image forming part 3 includes four process cartridges 3Y, 3M, 3C and 3K, a writing unit 30, four toner bottles 31Y, 31M, 31C and 31K, a transfer unit 32 and a fixing unit 33. The four process cartridges 3Y, 3M, 3C and 3K correspond to toners of total four colors, i.e., yellow, magenta, cyan (which are the three primary colors of color materials) and black (which is an achromatic color). The writing unit 30 is provided below the four process cartridges 3Y, 3M, 3C and 3K, and writes latent images onto respective photosensitive drums (described later). The four toner bottles 31Y, 31M, 31C and 31K contain news toners of the colors corresponding to the four process cartridges 3Y, 3M, 3C and 3K. The transfer unit 32 is such that images formed on the respective process cartridges 3Y, 3M, 3C and 3K are transferred onto the transfer unit 32, and then, the transferred images are transferred as a single image to a sheet of paper. The fixing unit 33 fixes the image onto the sheet of paper.

The process cartridges 3Y, 3M, 3C and 3K are arranged along a bottom surface of an intermediate transfer belt 32*a* (described later) in a stated order of yellow, magenta, cyan and black from an upstream side in a direction indicated by an arrow A in which the surface of the intermediate transfer belt 32*a* moves. The respective process cartridges 3Y, 3M, 3C and 3K are image forming units that are integrally molded and are detachable from the body 10 of the image forming apparatus 1, respectively. Each of the process cartridges 3Y, 3M, 3C and 3K includes a respective one of the photosensitive drums Y, M, C and K, which are latent image carrying members and are rotated clockwise. Each of the process cartridges 3Y, 3M, 3C and 3K further includes, around the photosensitive drum (the respective one of Y, M, C and K), an electrification part (the respective one of 34Y, 34M, 34C and 34K), a development part (the respective one of 30Y, 30M, 30C and 30K) and a cleaning part (the respective one of 35Y, 35M, 35C and 35K). The electrification part (the respective one of 34Y, 34M, 34C and 34K) carries out an electrification process and uniformly electrifies the outer surface of the photosensitive drum (the respective one of Y, M, C and K). The development part (the respective one of 30Y, 30M, 30C and 30K) visualizes an electrostatic latent image that has been formed by the writing unit 30 onto the respective one of the photosensitive drums Y, M, C and K into a toner image of the corresponding toner of the single color of the respective colors. The cleaning part (the respective one of 35Y, 35M, 35C and 35K) removes and collects the transfer residual toner remaining after the transfer of the toner image from the outer surface of the respective one of the photosensitive drums Y, M, C and K.

The writing unit 30 includes a polygon mirror 30*a* and *f*θ lenses 30*b*, and scans the photosensitive drums Y, M, c and K with laser light emitted by a laser emission unit 30*c* based on the image information input from the image reading part 2, a personal computer, an external scanner or such. The writing unit 30 selectively exposes, by the emitted light, the outer surfaces of the photosensitive drums Y, M, C and K having been uniformly electrified, to reduce the surface electric potentials at the light emitted areas of the outer surfaces of the photosensitive drums Y, M, C and K, and thus forms the electrostatic latent images on the photosensitive drums Y, M, C and K.

The toner bottles 31Y, 31M, 31C and 31K are individually filled up with the new toners of the above-mentioned four colors, respectively, and the toners of the respective colors are supplied to the development parts 30Y, 30M, 30C and 30K of the respective process cartridges 3Y, 3M, 3C and 3K via conveyance paths (not shown).

The transfer unit 32 is of an intermediate transfer system, and includes the intermediate transfer belt 32*a*, four supporting rollers 32*b*, 32*c*, 32*d* and 32*e*, four primary transfer rollers 32*f*, and a secondary transfer roller 32*g*. The intermediate transfer belt 32*a* acting as an intermediate transfer member is an endless belt made of a multilayered structure of resilient resin. The supporting rollers 32*b*, 32*c*, 32*d* and 32*e* support the intermediate transfer belt 32*a*, and the intermediate transfer belt 32*a* is wound on the supporting rollers 32*b*, 32*c*, 32*d* and 32*e*. The four primary transfer rollers 32*f* respectively face the photosensitive drums Y, M, C and K via the intermediate transfer belt 32*a*. The secondary transfer roller 32*g* is disposed to face the supporting roller 32*b*.

The supporting roller 32*b* acts as a driving roller connected to a driving part (not shown), and has a function of driving and rotating the intermediate transfer belt 32*a* in the direction of the arrow A. It is noted that the secondary transfer roller 32*g* is disposed at a position to face the supporting roller 32*b* (driving roller) via the intermediate transfer belt 32*a*. Near the supporting roller 32*c*, a cleaning unit 32*h* is provided to scrape the residual toner adhering to the outer surface of the intermediate transfer belt 32*a* and cleans the intermediate transfer belt 32*a*.

Each of the primary transfer rollers 32*f* is a transfer bias (transfer voltage) applying part of a contact applying type. In consideration of image degradation due to gap discharge, each of the primary transfer rollers 32*f* is disposed at a position slightly shifted, in the direction in which the surface of the intermediate transfer belt 32*a* moves to the downstream side, from a correct position of facing the respective one of the photosensitive drums Y, M, C and K with the center distance being shortest, via the intermediate transfer belt 32*a*. The primary transfer rollers 32*f* are connected to a bias power source (not shown), and thus, a primary bias can be applied to the reverse side (inner surface) of the intermediate transfer belt 32*a*.

The secondary transfer roller 32*g* is pressed by a pressing part (not shown) onto the outer surface of the intermediate transfer belt 32*a* to face the driving roller 32*b* via the intermediate transfer belt 32*a*, and creates a secondary transfer nip between the secondary transfer roller 32*g* and the driving roller 32*b*. The driving roller 32*b* acts as a transfer bias applying part of the contact applying type connected to a bias power source (not shown). Further, rather the secondary transfer roller 32*g* may act as the transfer bias applying part, and in this case, the transfer bias having a polarity opposite to that of the toner image is to be applied.

The fixing unit 33 is such that a fixing nip is created between a fixing belt 33*c* that is an endless belt wound on a fixing roller 33*a* and a heating roller 33*b*, and a pressing roller 33*d* acting as a pressing member that is pressed onto the fixing belt 33*c*. At the fixing nip, heat and pressure are applied to a sheet of paper having passed through the paper conveyance path 6 (described later), and the toner image having been transferred to the sheet of paper is molten, is adhered to and thus is fixed onto the sheet of paper.

The paper supply part 4 holds and stocks predetermined sheets of copy paper having different sizes, respectively, as sheets of paper. The paper supply part 4 includes paper supply cassettes 40, 41 that are capable of being drawn out from the body 10 of the image forming apparatus 1, and paper supply rollers 42, 43 that are resiliently pressed to the sheet of copy paper by a predetermined pressure from the top. Based on a control signal from a control part (not shown), a sheet of paper is supplied by means of a respective one of the paper supply rollers 42, 43 from the sheets of copy paper respectively held in the paper supply cassette 40, 41 to the paper conference path 6.

The paper supply part 4 includes a manual paper supply tray 44 on which any sheet of paper having a conveyable size within a predetermined range is placed and a paper supply roller 45 configured to feed the sheet of paper placed from the manual paper supply tray 44. The sheet of paper placed on the manual paper supply tray 44 is fed to the paper conveyance path 6 as a result of the paper supply roller 45 being driven and rotated.

The paper ejection part 5 includes a paper ejection tray 50 that has an inclined surface and is formed between the toner bottles 31Y, 31M, 31C and 31K and the image reading part 2. The paper ejection part 5 is of a type of being included in the body 10 of the image forming apparatus 1, and has a function such that sheets of paper ejected from a paper ejection opening 64 (described later) by means of a paper ejection roller 63 (described later) are accumulated onto the paper ejection tray 50. Further, radiation openings R1, R2 (described later) that are openings configured to radiate heat generated in the image forming part 3 to the outside air are provided on the paper ejection tray 50. The radiation openings R1, R2 will be described later.

The paper conveyance path 6 includes a regular conveyance path 60 and an inverting conveyance path 61. The regular conveyance path 60 is used in a vertical conveyance method (vertical path method) of conveying a sheet of paper upward from the paper feeding part 4 provided at the bottom part of the body 10 of the image forming apparatus 1 to the paper ejection part 5 provided at the top part of the body 10 of the image forming apparatus 1. The inverting conveyance path 61 is used to inverting a sheet of paper for the purpose of duplex printing. In the regular conveyance path 60 and the inverting conveyance path 61, plural pairs of conveyance rollers CR are provided at intervals corresponding to the minimum paper size, and a sheet of paper is conveyed as a result of the pairs of conveyance rollers CR sandwiching the sheet of paper and being rotated.

In the regular conveyance path 60, a pair of registration rollers 62 are provided below the secondary transfer nip and a pair of paper ejection rollers 63 are provided near the end in the paper conveyance direction, in addition to the conveyance rollers. Timing of conveying a sheet of paper to the secondary transfer nip is adjusted by the pair of registration rollers 62 based on an instruction given by a control part (not shown). Then, the image is transferred to the sheet of paper from the intermediate transfer belt 32*a*. Then, the fixing unit 33 fixes the image onto the sheet of paper as the sheet of paper onto which the image has been thus transferred passing through the fixing unit 33. Then, the sheet of paper is ejected to the paper ejection part 5 through the paper ejection opening 64 by means of the pair of paper ejection rollers 63.

Switching between the regular conveyance path 60 and the inverting conveyance path 61 is carried out by a switching claw 65. A sheet of paper guided by the switching claw 65 is removed from the regular conveyance path 60, is conveyed to an upper conveyance path 67 of the inverting conveyance path 61 by means of a pair of inverting conveyance rollers 66. As a result of the pair of inverting conveyance rollers 66 being rotated in reverse, leading and trailing edges of the sheet of paper are switched in a switchback manner, and the front and rear sides of the sheet of paper are replaced while the sheet of paper is conveyed to the regular conveyance path 60 before the pair of registration rollers 62.

(Image Forming Operation)

Next, with reference to FIG. 1, an image forming operation of the color copier 1 will be described.

When a photocopy of an original is carried out, the press plate 24 is opened and the original is set onto the contact glass 20 of the image reading part 2. It is noted that in the case where the ADF is provided instead of the press plate 24, the original is set on an original table of the ADF. Next, a start switch of an operation panel (see FIG. 2) is pressed, the image reading part 2 is driven, light emitted by the light source 21 that is running is reflected by a surface of the original, the reflected light is reflected by the plural mirrors 25, 26 and 27, an image is formed on the image sensor 23 by the reflected light having passed through the imaging lens 22, and the formed image is then converted into an electronic signal. Thus, the image (contents) of the original is read by the image reading part 2. It is noted that in the case where the ADF is provided, the original is automatically conveyed onto the contact glass 20 from the original table, and then the above-mentioned operations are carried out. Then, an image forming operation is started in a full color mode or a monochrome mode according to a mode setting selected from the operation panel or such.

First, a case where the full color mode is selected and a color image is formed will be described. When an image forming operation is started in the color copier 1, the respective photosensitive drums Y, M, C and K are rotated clockwise. At this time, by means of the respective electrification parts 34Y, 34M, 34C and 34K, the outer surfaces of the respective photosensitive drums Y, M, C and K are uniformly electrified at a predetermined polarity (for example, minus polarity). Next, laser light is emitted from the writing unit 30 to the electrified surfaces of the respective photosensitive drums Y, M, C and K based on image information decomposed to the corresponding toner colors, and thus, electrostatic latent images are formed on the outer surfaces of the respective photosensitive drums Y, M, C and K. Then, the electrostatic latent images are visualized as toner images of single colors by the respective development parts 30Y, 30M, 30C and 30K. The corresponding primary rollers 32*f* apply primary transfer biases to the respective toner images which are then transferred onto the intermediate transfer belt 32*a* in a superposing manner in sequence. Thus, a full color toner image is formed on the intermediate transfer belt 32*a*. In a case where a monochrome image is formed, the above-mentioned operations are carried out by means of the black process cartridge 3K.

On the other hand, sheets of paper stocked in the paper supply cassettes 40, 41 of the paper supply part 4 are fed to the paper conveyance path 6, sheet by sheet, by means of the paper supply rollers 42, 43. Then, the sheet of paper is raised through the paper conveyance path 6, and is stopped when the leading edge of the sheet of paper runs against the pair of registration rollers 62. As a result of running against the pair of the registration rollers 62, the leading edge of the sheet of paper is adjusted. Then, the pair of registration rollers 62 are rotated at timing when the color toner image formed on the intermediate transfer belt 32*a* reaches the secondary transfer nip. Thus, the sheet of paper is fed toward the secondary transfer nip.

Next, at the secondary transfer nip, the full color toner image on the intermediate transfer belt 32*a* (to which a secondary transfer bias is applied) is transferred to the sheet of paper by means of electrostatic force, and then, the sheet of paper is fed to the fixing nip of the fixing unit 33. There, heat and pressure are applied to the sheet of paper by the fixing belt 33*c* and the pressing roller 33*d*, and thus, the toner image that is carried but has not yet been fixed onto the sheet of paper is fixed onto the sheet of paper. After the toner image is thus fixed onto the sheet of paper, the sheet of paper is ejected onto the paper ejection tray 50 as a result of the paper ejection roller 63 being rotated.

Further, in a case where a duplex mode is selected and duplex copying (or duplex printing) is carried out, the switching claw 65 switches the conveyance path, and the sheet of paper on which a toner image has been fixed to one side is temporarily stocked at the upper conveyance path 67 of the inverting conveyance path 61. After that, the pair of inverting conveyance rollers 66 reverses the moving direction of the sheet of paper in the switchback manner, the conveyance rollers CR convey the sheet of paper through the inverting conveyance path 61, and the sheet of paper is thus again fed to before the pair of registration rollers 62. Then, image forming is carried out on the reverse side of the sheet of paper in the same way as that having been carried out for the above-mentioned image forming on the front side of the sheet of paper.

It is noted that the residual toners on the photosensitive drums Y, M, C and K are cleaned by the respective cleaning parts 35Y, 35M, 35C and 35K. After that, the electrification parts 34Y, 34M, 34C and 34K apply biases, in which AC components are added to DC components, respectively, to the photosensitive drums Y, M, C and K, and thus removal of electricity and at the same time uniform electrification of the photosensitive drums Y, M, C and K are carried out. Further, the residual toner on the intermediate transfer belt 32*a* is cleaned by the cleaning unit 32*h*, and thus, a preparation for a subsequent image forming operation is carried out.

(Radiation Part)

Next, with reference to FIGS. 2 through 6, radiation parts of the color copier 1 will be described.

Figure 3:
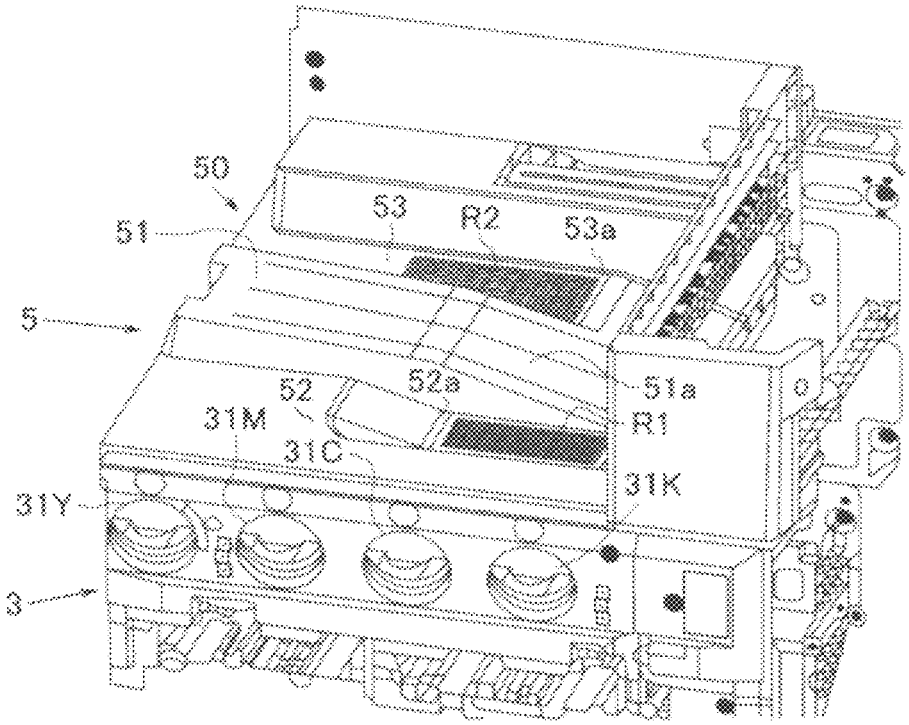
FIG. 3 partially shows a perspective view of the image forming apparatus shown in FIG. 1 especially around a paper ejection tray taken from a top-front-right oblique direction in a state where a front panel and an exterior panel of a body of the image forming apparatus are removed.
Figure 4:
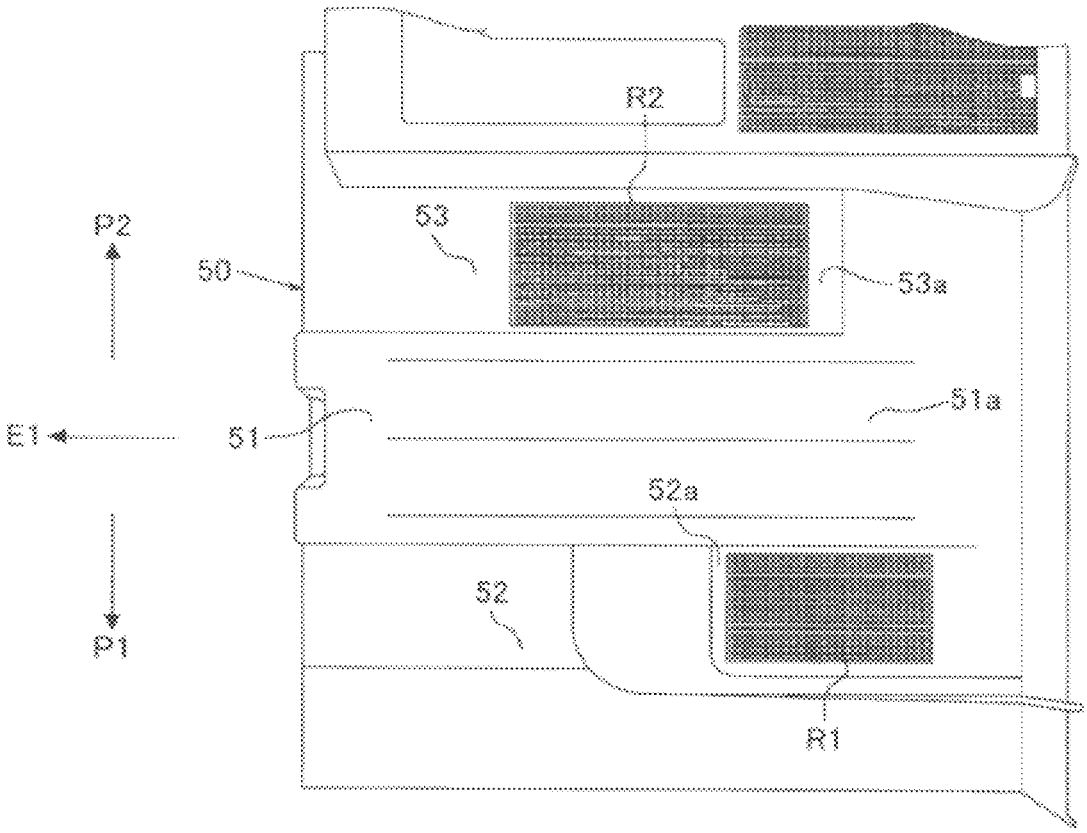
FIG. 4 shows a plan view of the paper ejection tray of the image forming apparatus shown in FIG. 1.

The radiation parts of the color copier 1 include, as shown in FIGS. 3 and 4, the two radiation openings R1 and R1 provided on the paper ejection tray 50. The radiation parts including the radiation openings R1 and R2 have a function of radiating heat generated in the image forming part 3 to the outside air by means of natural convection.

As shown in FIG. 3, the paper ejection tray 50 is provided immediately above the toner bottles 31Y, 31M, 31C and 31K of the image forming part 3, and a projection 51 and two depressions 52, 53 are formed on the surface of the paper ejection tray 50 (acting as the top surface of the image forming part 3).

The projection 51 extends along the center line of the paper ejection tray 5 in the direction in which the sheet of paper is ejected. The projection 51 has a predetermined width, is higher than a surrounding surface, and is like a horseback (see FIGS. 3 and 4). In order to guide the leading edge of the ejected sheet of paper, the projection 51 has a top part having a smooth and gentle surface, and has an inclined surface 51*a* near the paper ejection opening 64 which surface is inclined upward along the direction in which the sheet of paper is ejected. Further, the paper ejection tray 50 has the two depressions 52 and 53 left as a result of being defined by the projection 51.

The depressions 52, 53 have flat bottom surfaces 52*a*, 53*a*, respectively, at lowest areas depressed with respect to surrounding surfaces, respectively. The radiation openings R1 and R2 that are the radiation parts are formed on the bottom surfaces 52*a* and 53*a* of the depressions 52 and 53, respectively.

Figure 5:
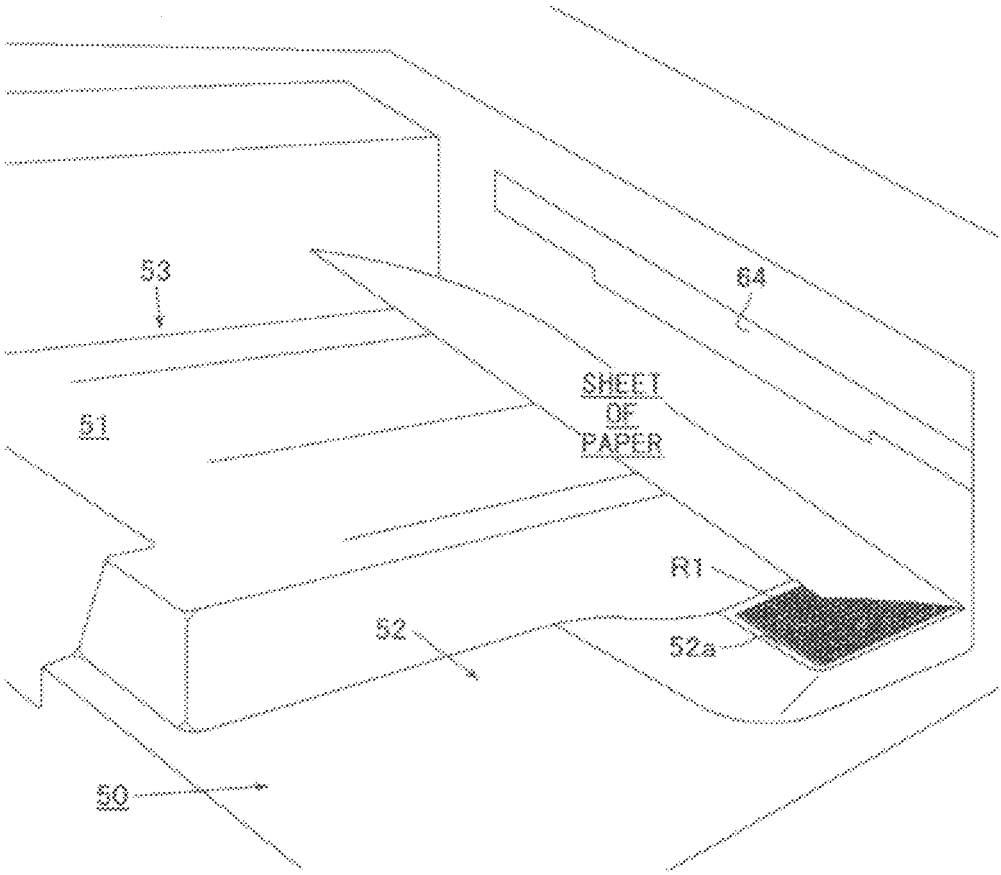
FIG. 5 shows a perspective view around the paper ejection tray of the image forming apparatus shown in FIG. 1 taken from a top-left-front oblique direction.
Figure 6:
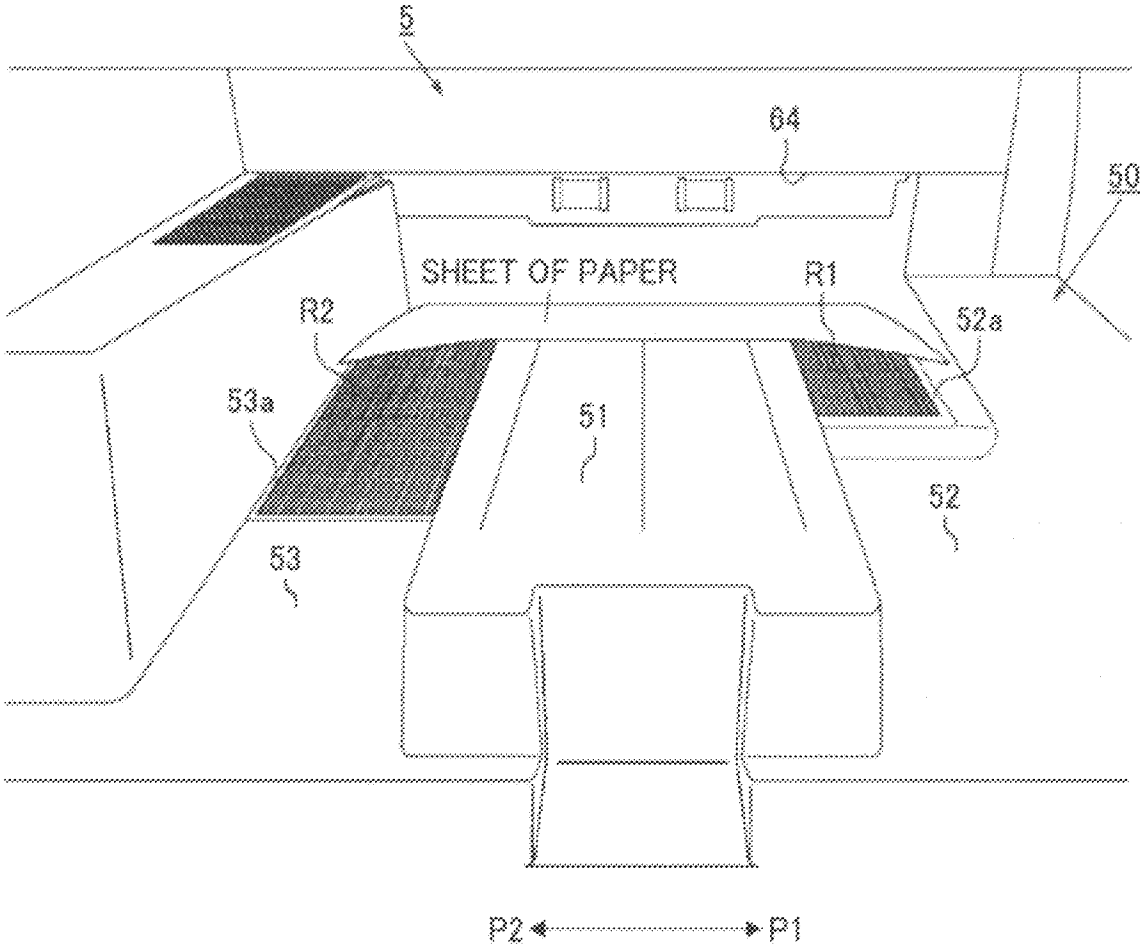
FIG. 6 shows a perspective view around the paper ejection tray of the image forming apparatus shown in FIG. 1 taken from a left side direction.

Therefore, as shown in FIGS. 5 and 6, even when the sheets of paper are ejected and thus become stacked onto the paper ejection tray 50, the radiation openings R1 and R2 are prevented from being blocked by the stacked sheets of paper. This is because the stacked sheets of paper on the paper ejection tray 50 is raised as a result of riding on the projection 51, and thus, the stacked sheets of paper are separated upward from the radiation openings R1 and R2 of the depressions 52 and 53, respectively, as shown in FIGS. 5 and 6. Thus, heat generated by the image forming part 3 or such can be radiated to the outside air through the radiation openings R1 and R2 sufficiently by means of natural convection. Further, when the user of the color copier 1 is to take the sheets of paper thus stacked on the paper ejection tray 50 by his or her hand, the user can easily insert his or her hand below the stacked sheets of paper because the depressions 52, 53 are formed. Thus, the user can easily take off the stacked sheets of paper from the paper ejection tray 50.

Figure 12:
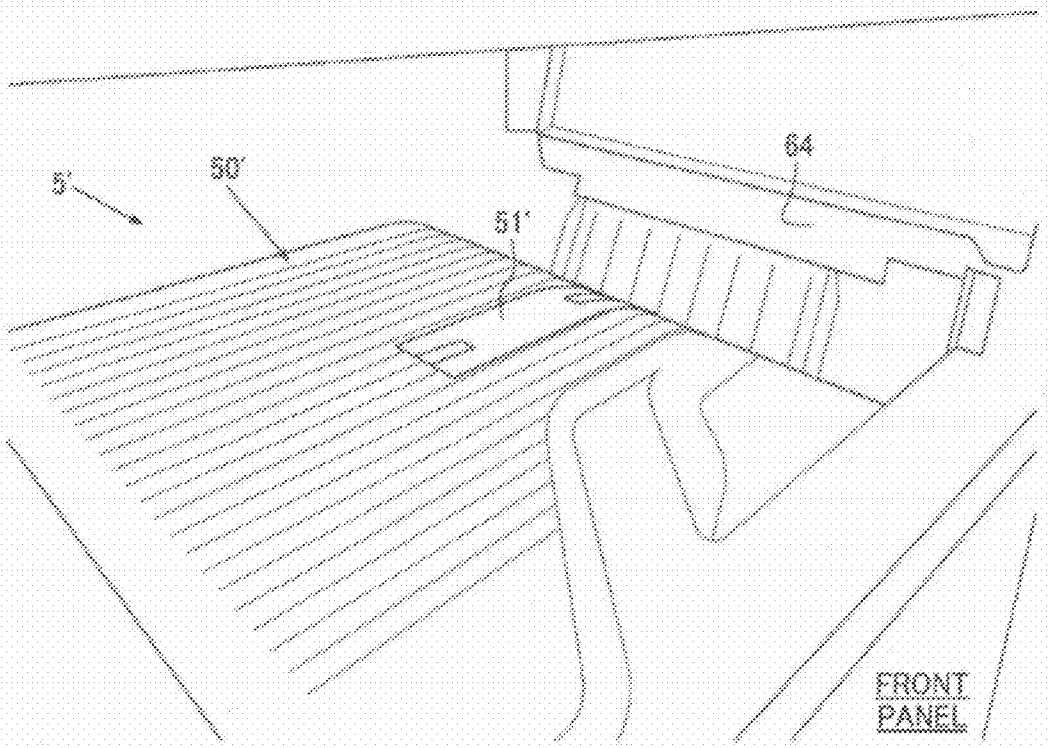
FIG. 12 shows a magnified view of the paper ejection tray of the image forming apparatus in the embodiment 2 of the present invention, in a state where a projection of the paper ejection tray is retracted, taken from the top-left-front oblique direction.
Figure 13:
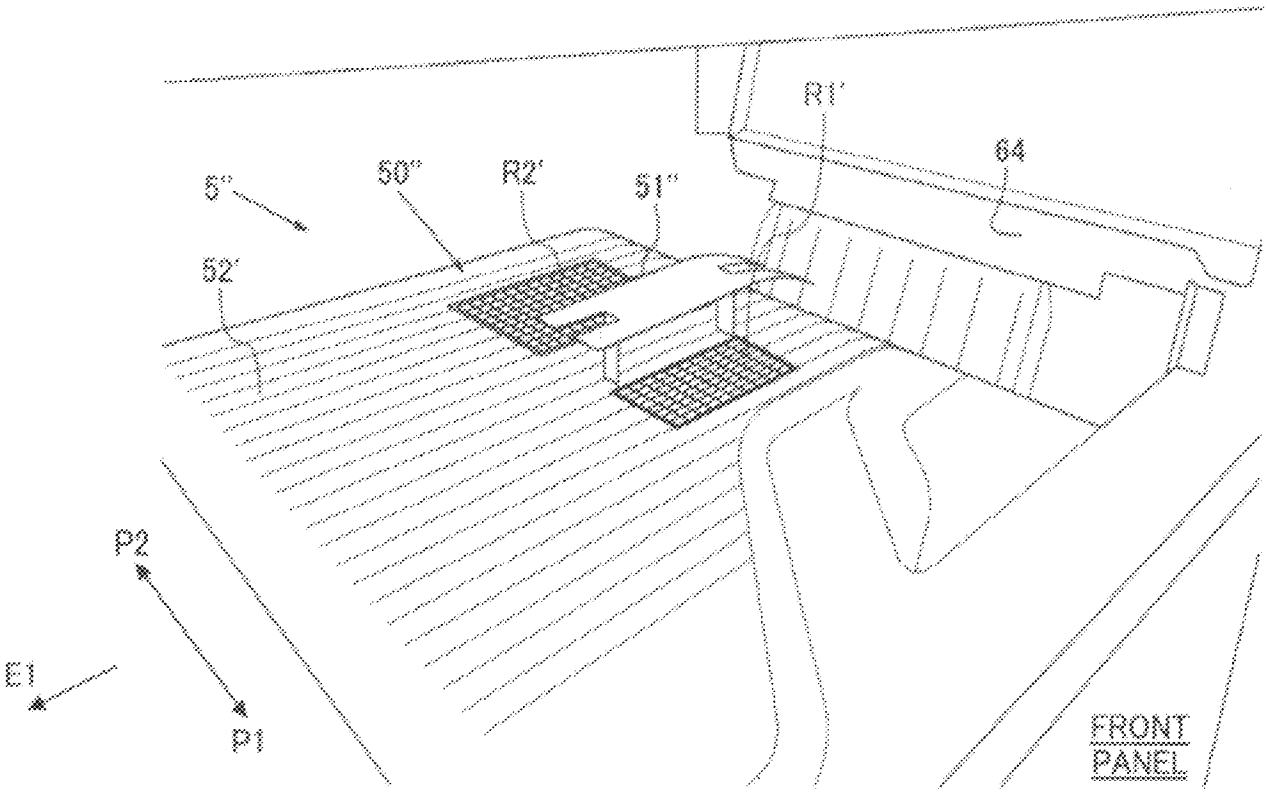
FIG. 13 shows a magnified view of a paper ejection tray of an image forming apparatus in a variant embodiment of the embodiment 1 of the present invention taken from a top-left-front oblique direction.
Figure 14:
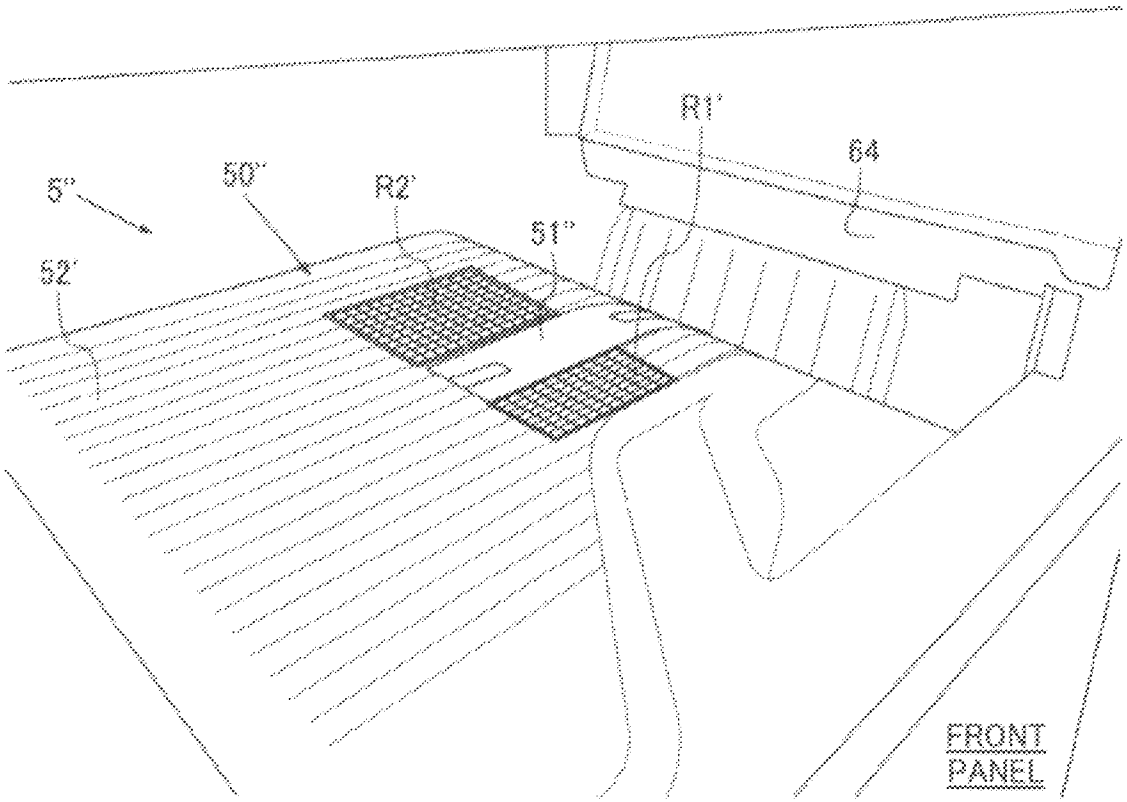
FIG. 14 shows a magnified view of the paper ejection tray of the image forming apparatus in the variant embodiment of the embodiment 1 of the present invention, in a state where a projection of the paper ejection tray is retracted, taken from the top-left-front oblique direction.

It is noted that as shown in FIGS. 13 and 14, the projection 51 may be replaced by a projection 51" that is movable (retractable), the same as a movable projection 51' in the embodiment 2 described later with reference to FIGS. 11 and 12, and the remaining area of the surface of a paper ejection tray 50" (corresponding to the paper ejection tray 50) other than the projection 51" may be used as a depression 52' instead of the depressions 52 and 53. Further, radiation openings R1' and R2' may be formed on the depression 52'. Also in this case (i.e., a paper ejection part 5" according to the variant embodiment of the embodiment 1), when the projection 51" is raised as shown in FIG. 13, the same as the case described above with reference to FIGS. 2 through 6, the radiation openings R1' and R2' as the radiation parts are prevented from being blocked by the sheets of paper ejected and stacked onto the paper ejection tray 50". This is because, the same as the case of FIGS. 2 through 6, the stacked sheets of paper ride on the projection 51" of the paper ejection tray 50", and thus the stacked sheets are separated upward from the radiation openings R1' and R2'. Therefore, heat generated by the image forming part 3 or such can be radiated to the outside air through the radiation openings R1, R2 sufficiently by means of natural convection.

Figure 8:
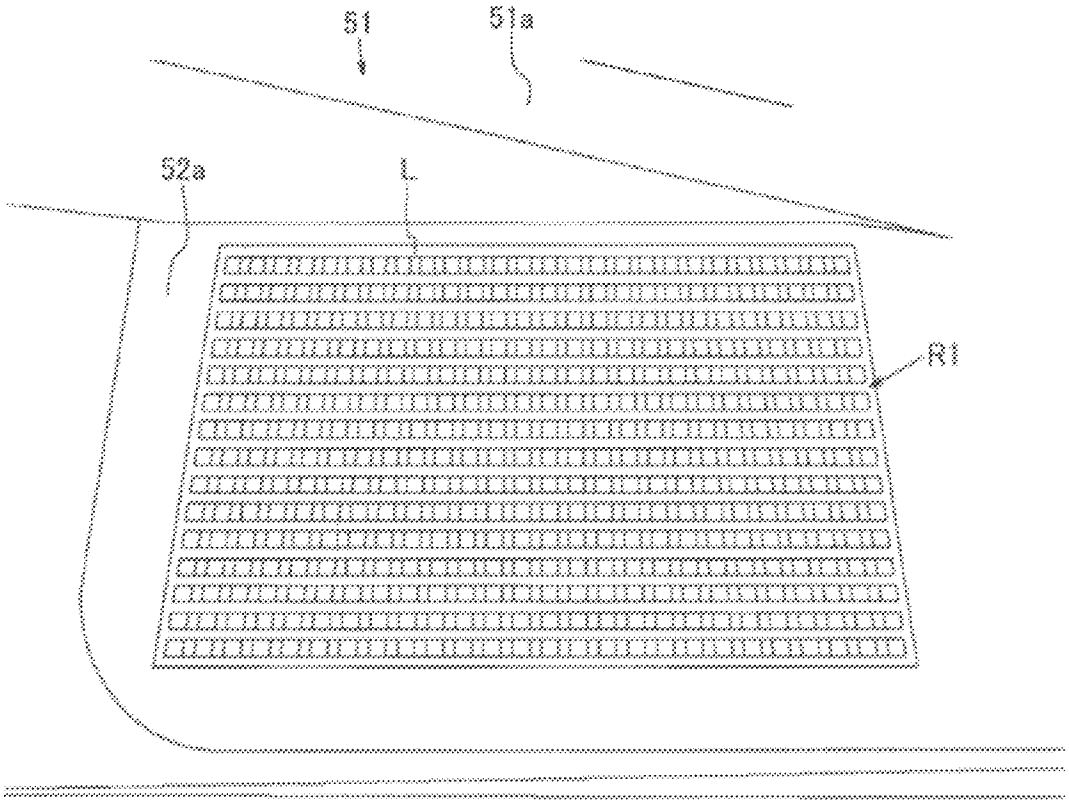
FIG. 8 shows a magnified perspective view of the grid of the image forming apparatus shown in FIG. 1, which is fit into the radiation opening, taken from a top-front oblique direction.
Figure 9:
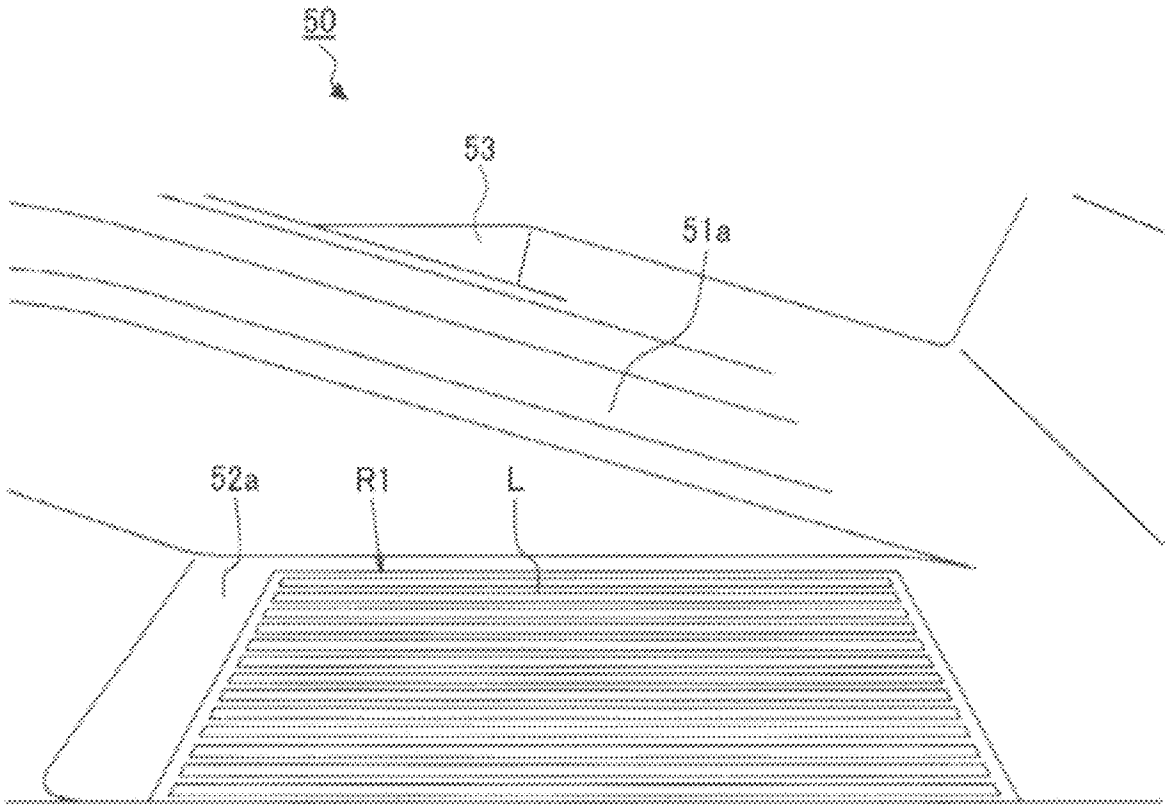
FIG. 9 shows a magnified perspective view of the grid of the image forming apparatus shown in FIG. 1, which is fit into the radiation opening, taken by a line of a sight of a user of the image forming apparatus.

Next, with reference to FIGS. 7, 8 and 9, grids fitted into the radiation openings R1, R2 will be described.

In order to prevent the user's hand from erroneously being inserted or a foreign body from entering the inside of the body 10 of the image forming apparatus 1 through the radiation openings R1, R2, grids L are fitted into the radiation openings R1, R2, respectively. In order to prevent the radiation openings R1, R2 from being regarded as "openings of the housing of the image forming apparatus 1" according to a safety standard, the maximum length X of each individual opening IO of the grids L (i.e., the length of the inside dimension of a diagonal line of each individual opening IO of the grids L, see FIG. 7) is determined as being equal to or less than 5 mm. As a result, a situation where materials or such of parts/components provided in the inside of the radiation openings R1, R2 are limited by the safety standard can be avoided. Further, a situation where providing the radiation openings R1, R2 is not allowed by the safety standard because of parts/components provided in the inside of the radiation openings R1, R2 can be avoided. Thus, freedom in designing is improved, and this is advantageous in downsizing the image forming apparatus 1.

Figure 7:
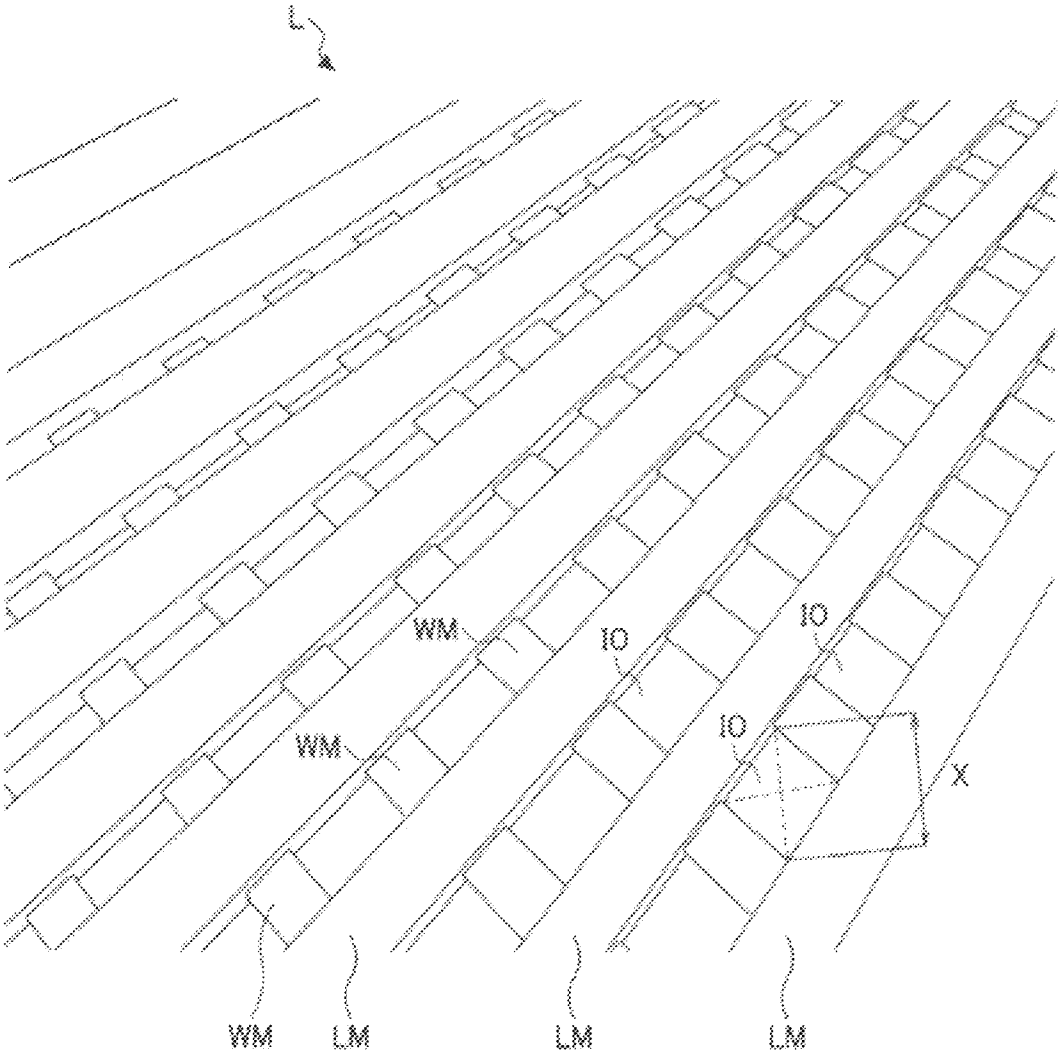
FIG. 7 shows a magnified perspective view of a grid provided at a radiation opening of the image forming apparatus shown in FIG. 1.

Each of the grids L is configured, for example, as shown in FIG. 7, by longitudinal members LM and width members WM. The longitudinal members LM extend along the longitudinal direction of the grid L in parallel at predetermined intervals. The width members WM are inserted between each adjacent ones of the longitudinal members LM and therewith, the space between the adjacent longitudinal members LM are maintained. Rectangular spaces 10 defined by the longitudinal members LM and the width members WM correspond to the respective individual openings 10.

Further, the radiation openings R1, R2 are provided on the flat bottom surfaces 52*a*, 53*a* that are depressed with respect to respective surrounding surfaces on the depressions 52, 53, and also, the grids L are fitted into the radiation openings R1, R2. In this configuration, the necessary opening areas of the radiation openings R1, R2 for radiating the heat can be ensured. Further, as shown in FIG. 9, when viewed from a front-top oblique direction of the paper ejection tray 50 which is a usual sight line when the user carries out a printing or copying operation, the insides of the radiation openings R1, R2 are not conspicuous and thus the appearance is improved from a design viewpoint.

Figure 10:
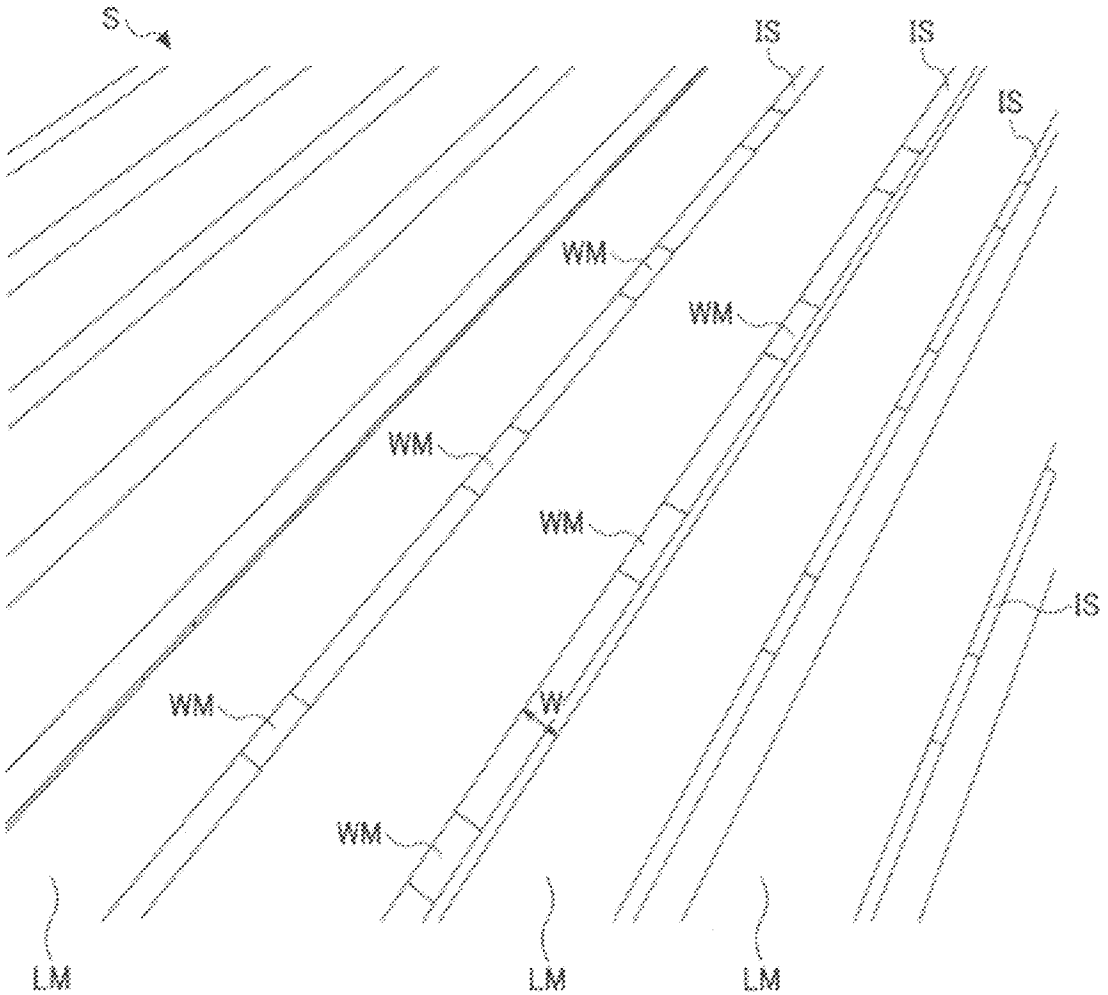
FIG. 10 shows a magnified perspective view of a configuration of a slit member that is a variation example of the grid of the image forming apparatus shown in FIG. 1.

Further, FIG. 10 shows a configuration of a slit member S as a variant embodiment of the grids L. In the slit members S, the width W of each individual slit IS is determined to be equal to or less than 1 mm, and as a result, the same as the above-mentioned case of the grids L, the radiation openings R1, R2 into which the slit members S are fitted are not regarded as "openings of the housing of the image forming apparatus 1" according to the safety standard. As a result, such a situation that materials or such of parts/components provided in the inside of the radiation openings R1, R2 are limited by the safety standard can be avoided. Further, such a situation that providing the radiation openings R1, R2 is not allowed by the safety standard because of parts/components provided in the inside of the radiation openings R1, R2 can be avoided. Thus, freedom in designing is improved, and this is advantageous in downsizing the image forming apparatus 1.

Further, in the user's line of sight, the insides of the radiation openings R1, R2 are not conspicuous and thus the appearance is improved from a design viewpoint.

Each of the slit members S (instead of the grids L) is configured, for example, as shown in FIG. 10, by longitudinal members LM and width members WM. The longitudinal members LM extend along the longitudinal direction of the slit member S in parallel at predetermined intervals. The width members WM are inserted between each adjacent ones of the longitudinal members LM and therewith, the space between the adjacent longitudinal members LM are maintained. Rectangular spaces IS defined by the longitudinal members LM and the width members WM correspond to the respective individual slits IS.

Thus, the radiation parts of the color copier 1 according to the embodiment 1 of the present invention are such that the projection 51 and the depressions 52, 53 are formed on the surface of the paper ejection tray 50. Further, the radiation openings R1, R2 are provided on the respective flat bottom surfaces 52*a*, 53*a* of the depressions 52, 53. Thereby, even when sheets of paper are ejected onto the paper ejection tray 50, the radiation openings R1, R2 are prevented from being blocked by the stacked sheets of paper. Thus, by using the radiation openings R1, R2, it is possible to radiate heat generated by the image forming part 3 or such to the outside air through the radiation openings R1, R2 sufficiently even by means of natural convection.

Further, as shown in FIGS. 4 and 6 for example, the projection (supporting part) 51 is disposed at the position in the direction P2 with respect to the radiation opening R1, which direction P2 is different from the direction P1. The direction P1 is parallel to the plane on which the paper ejection tray 50 extends, is perpendicular to the direction E1 in which the sheet of paper is ejected after having the image formed thereonto by the image forming part 3, and is directed toward the outside of the paper ejection tray 50 from the radiation opening R1.

Thereby, the projection 51 does not obstruct an air flow of the heated air discharged from the radiation opening R1 toward the outside of the paper ejection tray 50 in the direction P1.

Further, as shown in FIG. 13 for example, the projection (supporting part) 51" is disposed at the position in the direction P2 with respect to the radiation opening R1', which direction P2 is different from the direction P1. The direction P1 is parallel to the plane on which the paper ejection tray 50" extends, is perpendicular to the direction E1 in which the sheet of paper is ejected after having the image formed thereonto by the image forming part 3, and is directed toward the outside of the paper ejection tray 50" from the radiation opening R1'.

Similarly, as shown in FIG. 13 for example, the projection (supporting part) 51" is disposed at the position in the direction P1 with respect to the radiation opening R2', which direction P1 is different from the direction P2. The direction P2 is parallel to the plane on which the paper ejection tray 50" extends, is perpendicular to the direction E1 in which the sheet of paper is ejected after having the image formed thereonto by the image forming part 3, and is directed toward the outside of the paper ejection tray 50" from the radiation opening R2'.

Thereby, at least the projection 51" does not obstruct an air flow of the heated air discharged from the radiation opening R1' or R2' toward the outside of the paper ejection tray 50" in the direction P1 or P2.

Embodiment 2

Next, with reference to FIGS. 11 and 12, an image forming apparatus according to an embodiment 2 will be described.

A color copier 1' illustrated as one example of the image forming apparatus according to the embodiment 2 of the present invention is the same as the color copier 1 according to the embodiment 1 described above except for only a radiation part and a paper ejection tray 50' of a paper ejection part 5' relating to the radiation part. Therefore, only parts different from those of the color copier 1 will be described, and as for the other parts the same as those of the color copier 1 according to the embodiment 1, the same reference numerals are given, and duplicate description will be omitted.

Figure 11:
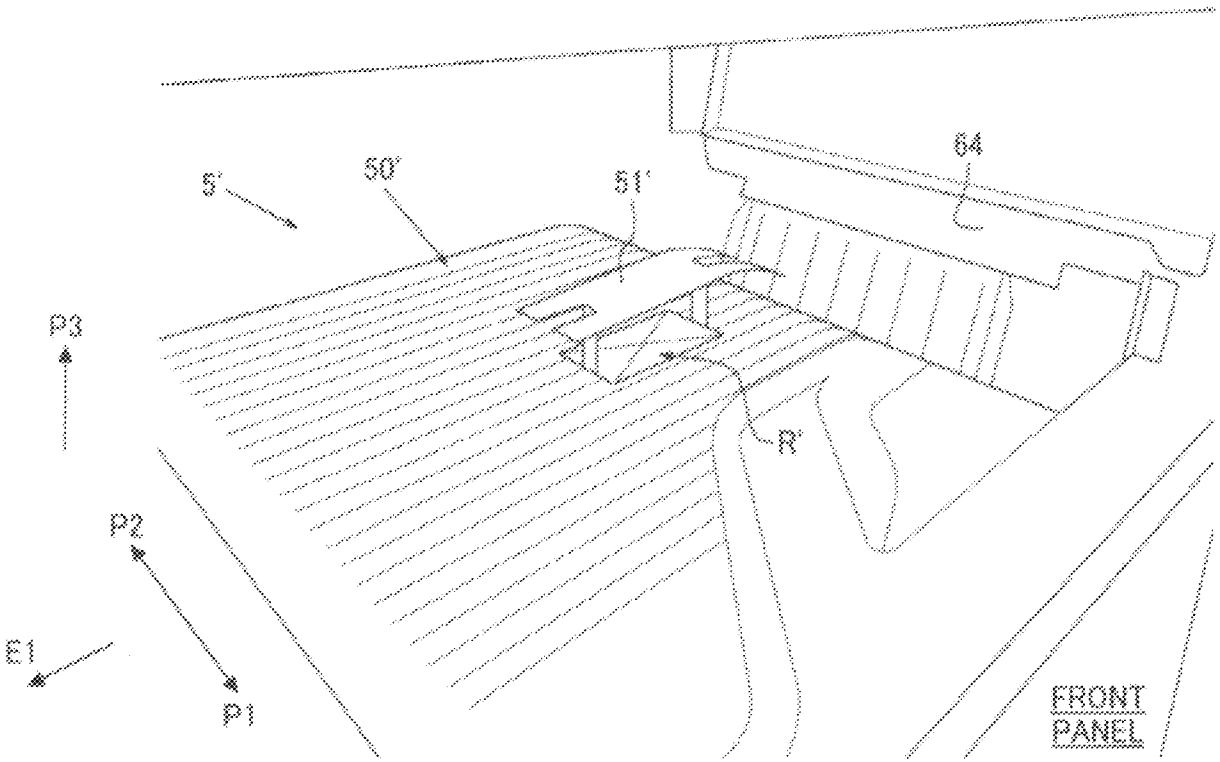
FIG. 11 shows a magnified view of a paper ejection tray of an image forming apparatus in an embodiment 2 of the present invention taken from a top-left-front oblique direction.

As shown in FIG. 11, the radiation part of the color copier 1' in the embodiment 2 includes a single radiation opening R' provided on the paper ejection tray 50' and has a function of radiating heat by means of natural convection.

In the paper ejection tray 50', as shown in FIGS. 11 and 12, the movable projection 51' is provided which is configured to be moved between a position where the projection 51' projects upward from a surrounding surface as shown in FIG. 11 and a position where the projection 51' becomes flush with the surrounding surface as shown in FIG. 12. In the state where the projection 51' projects upward from the surrounding surface as shown in FIG. 11, a part indicated by a mark of "X", provided in the inside of the projection 51', acts as the radiation opening R'.

Although not shown, in the radiation opening R', a member similar to the above-mentioned grid L or the slit member S is provided or fitted. By means of the member similar to the above-mentioned grid L or the slit member S, it is possible to ensure the necessary open area for radiating the heat, and also, it is possible to prevent the user's hand from erroneously being inserted into the radiation opening R' or a foreign body from entering the inside of the body 10 of the image forming apparatus (i.e., the color copier) 1' through the radiation opening R'.

In the radiation part (R') of the image forming apparatus 1' according to the embodiment 2 of the present invention, as a result of the movable projection 51' being caused to project upward as shown in FIG. 11, the projection 51' is made higher than a surrounding surface on the paper ejection tray 50'. Thus, it is possible to create a difference in level between the projection 51' and the other part of the paper ejection tray 50'. Therefore, the radiation opening R' provided immediately below the movable projection 51' is prevented from being blocked by the sheets of paper ejected and stacked onto the paper ejection tray 50'. This is because the stacked sheets of paper on the paper ejection tray 50' ride on the movable projection 51'. Thus, the heat generated by the image forming part 3 or such can be radiated to the outside air through the radiation opening R' efficiently by means of natural convection. Further, in a case where it is not necessary to radiate the heat of the image forming part 3 or such to the outside air as a case of transporting the image forming apparatus 1' or so, it is possible that as shown in FIG. 12, the movable projection 51' is retracted and the radiation opening R' is closed therewith. Thus, it is possible to prevent dust/dirt from entering the body 10 of the image forming apparatus 1'.

Further, as shown in FIG. 6 for example, the projection (supporting part) 51 is disposed at the position in the direction P1 with respect to the radiation opening R1, which direction P1 is different from the direction P2. The direction P2 is parallel to the plane on which the paper ejection tray 50 extends, is perpendicular to the direction E1 in which the sheet of paper is ejected after having the image formed thereonto by the image forming part 3, and is directed toward the outside of the paper ejection tray 50 from the radiation opening R1.

Further, as shown in FIG. 11 for example, the projection (supporting part) 51' is disposed at the position in the direction P3 with respect to the radiation opening R', which direction P3 is different from any one of the directions P1 and P2. Any one of the directions P1 and P2 is parallel to the plane on which the paper ejection tray 50' extends, is perpendicular to the direction E1 in which the sheet of paper is ejected after having the image formed thereonto by the image forming part 3, and is directed toward the outside of the paper ejection tray 50' from the radiation opening R2.

Thereby, the projection 51' does not obstruct an air flow of the heated air discharged from the radiation opening R' toward the outside of the paper ejection tray 50 in the direction P1 or P2.

The color copiers 1 and 1' of a type of paper ejection being carried out from the inside of the body 10 of the image forming apparatus, of an intermediate transfer type, of a 4-drum tandem type, and of an electrophotographic type have been described as examples of the image forming apparatuses 1 and 1' according to the embodiments 1 and 2 of the present invention. However, embodiments of the present invention are not limited thereto. The present invention may be applied to any common image forming apparatuses, such as a copier, a facsimile machine, a printer, a multifunction peripheral in which some of functions of a copier, a facsimile and a printer are combined, in which a paper ejection tray is provided above a part such as an image forming part that generates heat so that the paper ejection tray covers the body of the image forming apparatus for the purpose of saving a space of installing the image forming apparatus.

Further, the image reading part 2, the image forming part 3, the paper supply part 4, the paper ejection part 5, the paper conveyance path 5, and so forth, described above for the image forming apparatuses according to the embodiments of the present invention are those merely showing examples. Other known parts/units may be used instead. Also in such a case, it is clear that the same or similar functions/advantages as those of the above-described embodiments 1 and 2 can be obtained. Further, the shapes, structures and so forth of the respective parts/components shown in the figures are those merely showing preferable examples, and thus, design changes may be made within the scope of the claimed features.

The present invention is not limited to the specifically disclosed embodiments, and variations and modifications may be made without departing from the scope of the present invention.

The present application is based on Japanese Priority Patent Applications Nos. 2010-183853 and 2010-197258, filed on Aug. 19, 2010 and Sep. 3, 2010, the entire contents of which are hereby incorporated herein by reference.

What is claimed is:

1. An image forming apparatus comprising:

an image forming part configured to form an image on a sheet of paper; and a paper ejection tray, provided above the image forming part, including a supporting part configured to support the sheet of paper ejected after having the image formed thereonto by the image forming part, and a radiation opening configured to radiate heat from the image forming part to the outside air, wherein the radiation opening is provided lower than the supporting part, wherein the radiation opening is provided on a flat bottom surface which is depressed with respect to a surrounding surface that is a surface of the paper ejection tray, and wherein a distance from a paper ejection position to the supporting, in a direction along which the sheet of paper is ejected after having the image formed thereon, is shorter than a distance along the direction from the paper ejection position to the radiation opening.

2. The image forming apparatus as claimed in claim 1, wherein the radiation opening is disposed at a position that is shifted from a position of the supporting part in a direction parallel to a plane on which the paper ejection tray extends.

3. The image forming apparatus as claimed in claim 1, wherein the supporting part has an inclined surface that is inclined upward along a direction in which the sheet of paper is ejected after having the image formed thereonto by the image forming part, is higher than the surface on which the radiation opening is provided, and extends along the direction in which the sheet of paper is ejected after having the image formed thereon by the image forming part.

4. The image forming apparatus as claimed in claim 1, wherein the supporting part is movable between a position projected upward from a surrounding surface on the paper ejection tray and a position flush with the surrounding surface on the paper ejection tray.

5. The image forming apparatus as claimed in claim 1, wherein the radiation opening is disposed under the supporting part, and the supporting part is movable between a position projected upward from a surrounding surface on the paper ejection tray and a position flush with the surrounding surface on the paper ejection tray.

6. The image forming apparatus as claimed in claim 1, wherein the radiation opening has a grid in which a largest length of each of individual openings is equal to or less than 5 mm, or a slit member in which a width of each of individual slits is equal to or less than 1 mm.

7. The image forming apparatus as claimed in claim 1, wherein the supporting part is disposed at a position in a direction with respect to the radiation opening, which direction is different from a direction parallel to a plane on which the paper ejection tray extends, perpendicular to the direction in which the sheet of paper is ejected after having the image formed thereonto by the image forming part, and directed toward the outside of the paper ejection tray.

* * * * *